US005200287A

United States Patent [19]

Ohmura et al.

[11] Patent Number: 5,200,287

[45] Date of Patent: Apr. 6, 1993

[54] CARRIER FOR DEVELOPING ELECTROSTATIC IMAGE

[75] Inventors: Ken Ohmura, Hachioji; Kenji Tsujita, Kanagawa; Shigenori Kouno, Tokyo, all of Japan

[73] Assignee: Konica Corporation, Tokyo, Japan

[21] Appl. No.: 731,866

[22] Filed: Jul. 18, 1991

[30] Foreign Application Priority Data

Jul. 27, 1990 [JP] Japan ..... 2-197892

[51] Int. Cl.[5] ..... G03G 9/113

[52] U.S. Cl. ..... 430/108

[58] Field of Search ..... 430/106, 108

[56] References Cited

U.S. PATENT DOCUMENTS 4,522,907 6/1985 Mitsuhashi et al. ..... 430/102

5,034,298 7/1991 Berkes et al. ..... 430/110

*Primary Examiner*—John Goodrow

*Attorney, Agent, or Firm*—Finnegan, Henderson, Farabow, Garrett & Dunner

[57] ABSTRACT

A resin coated carrier for developing an electrostatic image is disclosed. The carrier coating layer comprises a silicone resin and a carbon fluoride having a BET specific surface area of not more than 100 $m^2/g$. The carrier imparts proper positive polarity triboelectric charge without charge control agent.

7 Claims, No Drawings

CARRIER FOR DEVELOPING ELECTROSTATIC IMAGE

FIELD OF THE INVENTION

The present invention relates to a carrier for developing an electrostatic image, comprising a core and a resin coat layer.

BACKGROUND OF THE INVENTION

Two-component developers used in electrophotography are comprised of a toner and a carrier. The carrier is used for the purpose of imparting triboelectric charges to the toner in a proper polarity and in a proper quantity.

In order to prevent toner-spent and increase the durability of the carrier, a carrier comprising a core coated with a silicone resin having low surface energy characteristics has been proposed (Japanese Patent Publication Open to Public Inspection (hereinafter referred to as Japanese Patent O.P.I. Publication) No. 127748/1987.

In the carrier having a resin coat layer comprising silicone resin, however, the silicone resin itself has not so high triboelectric chargeability that it is necessary for the toner to be incorporated with a charge control agent in order to impart positive-polarity and proper-range triboelectric charges to the toner.

Nonetheless, such a charge control agent is commonly disadvantageous in that it has a poor dispersibility to a binder resin of the toner and hence tends to give non-uniform triboelectric chargeability.

SUMMARY OF THE INVENTION

An object of the present invention is to provide a carrier for developing electrostatic image, that has superior triboelectric chargeability and can impart proper, positive-polarity triboelectric charges even to a toner containing no charge control agent.

The carrier for developing an electrostatic image according to the present invention comprises a core and a resin layer comprising i) a silicone resin with which said core is coated and ii) a carbon fluoride contained in said silicone resin, having a BET specific surface area of not less than 100 $m^2/g$.

Stated specifically, the silicone resin and the carbon fluoride are uniform in their surface energy, and hence the carbon fluoride has a good dispersibility to the silicone resin. Moreover, the carbon fluoride has a large BET specific surface area and an irregular shape, and hence it can strongly held to the silicone resin. Thus the carbon fluoride can be uniformly dispersed in the resin coat layer.

The carbon fluoride has also so strong a negative chargeability that the triboelectric chargeability insufficient for the silicone resin can be well compensated and the triboelectric chargeability of the carrier can be made proper.

It is therefore possible to impart proper triboelectric charges in a high rise to a toner containing no charge control agent.

In the resin coat layer, superior low surface energy characteristics are imparted not only because of the silicone resin but also because of the carbon fluoride. Hence it is possible to obtain a carrier that may hardly cause the toner-spent. More specificaly, the surface energy of a substance becomes lower with an increase in the contact angle of a liquid. Hence, the larger the contact angle of a liquid is, the greater the effect of preventing the toner-spent becomes. The contact angle of the silicone resin with respect to water is usually about 110° at 303K, and the contact angle of the carbon fluoride with respect to water is 141° to 143°. Here, the contact angle of the carbon fluoride is measured in the state where powdery carbon fluoride has been formed into a tablet. On the other hand, the contact angle of unfluorinated graphite with respect to water is 96°. If this graphite is used in combination with the silicone resin, the low surface energy characteristics inherent in the silicone resin may be damaged instead, so that no satisfactory effect of preventing the toner-spent can be exhibited.

Thus, the initial good triboelectric chargeability can be stably achieved even when images are repeatedly formed over a large number of times, and good images with a high image density can be formed without causing fog.

DETAILED DISCLOSURE OF THE INVENTION

The present invention will be described below in detail.

In the present invention, a silicone resin and a specific carbon fluoride are used as the materials that constitute the resin coat layer.

As the silicone resin, a condensation reaction type silicone resin can be preferably used which sets or cures as a result of the reaction as shown, for example, by the following scheme (1) or (2).

(1) Heat dehydration condensation reaction:

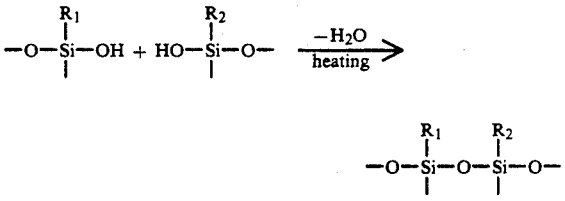

(2) Room temperature moisture-curing reaction:

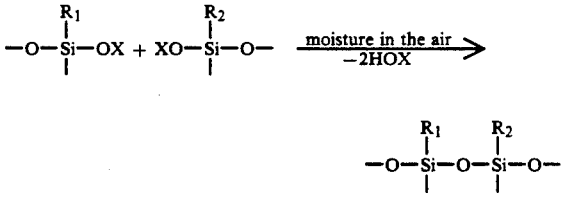

wherein OX represents an alkoxy group, a ketoxime group, an acetoxy group, an aminoxy group or the like.

In the present invention, a condensation reaction type silicon resin wherein the substituents $R_1$ and $R_2$ are methyl groups can be particularly preferably used. Such a resin make dense the structure of the resin coat layer to give a carrier with a high water repellency and good moisture resistance.

Any of heat-curable silicone resins and room temperature curable resins can be used as the condensation reaction type silicone resin. In the case when the heat-curable silicone resins are used, it is necessary for them to be heated at about 200° C. to about 250° C. In the case when the room temperature curable resins are used, it is not necessary for them to be heated to a particularly high temperature for their curing. They, however, may be heated within the temperature range of from 150° C. to 220° C. so that the curing can be accelerated.

The room temperature curable resins are silicone resins capable of being cured at temperatures of about 20° C. to 25° C. or temperatures slightly higher than these, in a usual atmosphere. They require no heating at temperatures higher than 100° C. for their curing.

Commercially available products of the condensation reaction type silicone resins are exemplified by SR-2400, SR-2406, SR-2410 and SR-2411 (all available from Toray Silicone Co., Ltd.); and KR-152, KR-271, KR-251, KR-220 and KR-255 (all available from Shin-Etsu Chemical Co., Ltd.).

The silicone resin may preferably have a value of Si/C, the weight ratio of silicon to carbon, of 1.7 to 2.2 so that the resin coat layer can be made tough. A silicone resin with an excessively large value of this weight ratio tends to make the chargeability susceptible to moisture changes, resulting also in a brittle coat layer. On the other hand, a silicone resin with an excessively small value thereof may result in an undesirably soft coat layer.

In the present invention, the carbon fluoride used in combination with the silicone resin as a component material of the resin coat layer has a BET specific surface area of not less than 100 $m^2/g$, preferably not less than 120 $m^2/g$, and more preferably not less than 180 $m^2/g$. A carbon fluoride with a BET specific surface area of up to about 100 $m^2/g$ is used. A carbon fluoride with a BET specific surface area of less than 100 $m^2/g$ may give so poor a binding between the carbon fluoride and the silicone resin that prticles of carbon fluoride may come off from the carrier surfaces while the carrier is used, resulting in an insufficient effect of preventing the toner-spent.

The carbon fluoride refers to carbon monofluoride, polydicarbon monofluoride or polytetracarbon monofluoride that is produced by heating a carbon source such as carbon black, crystalline graphite or petroleum coke at a high temperature in the presence of fluorine gas. It is usually abridged as CFx, wherein x represents a fluorine content, which is usually not more than 1.2.

The carbon fluoride may preferably have an average particle diameter of not more than 1 μm so that it can be strongly held to the silicone resin.

The carbon fluoride may be contained in the resin coat layer in an amount preferably within the range of from 5% by weight to 60% by weight so that uniform dispersion of the carbon fluoride can be surely achieved. An amount more than 60% by weight for the content of carbon fluoride makes it difficult for the carbon fluoride to be uniformly dispersed in the resin coat layer and also causes separation of the carbon fluoride from carrier surfaces. This tends to make it difficult to solve the problems involved in the prior art. On the other hand, an amount less than 5% by weight for the content of carbon fluoride tends to bring about a decrease in the durability of the carrier.

As the core of the carrier, a magnetic material can be preferably used. As to the magnetic material, when the triboelectric chargeability to toners and the adhesion of carriers to a photosensitive member are taken into account, it may preferably have a weight average particle diameter within the range of from 20 μm to 200 μm, and particularly 30 μm to 120 μm. Weight average particle diameter of the carrier is a value obtained by measurement under dry conditions using Microtrack Type 7981-OX, manufactured by LEEDS & NORTHRUP CO.

As materials for the magnetic material, it is possible to use materials capable of being strongly magnetized by the application of, and in the direction of, a magnetic field, as exemplified by ferrite and magnetite. Here, the ferrite is a generic term of magnetic oxides containing iron, and is not limited to the spinel type ferrite represented by the chemical formula of $MO.Fe_2O_3$. In the above chemical formula, M represents a divalent metal atom, and specifically represents nickel, copper, zinc, manganese, magnesium, lithium, etc.

The carrier may preferably have a resistivity of $10^7$ Ω·cm to $10^{14}$ Ω·cm, and particularly preferably $10^8$ Ω·cm to $10^{11}$ Ω·cm so that the reproduction of solid images and the reproduction of characters and line images can be improved.

There are no particular limitations on the manner by which the resin coat layer is formed. For example, the resin coat layer can be formed by a process comprising the steps of coating the surface of a core with a coating solution prepared by subjecting a silicone resin (liquid) and a carbon fluoride (powdery) to ultrasonic dispersion in a solvent, thereafter evaporating and removing the solvent usually by drying with heating, and curing the coating layer at the time of the drying or after the drying.

A specific coating means may include the dipping in which core powder is dipped in the coating solution, the spraying in which the coating solution is sprayed to the core, the fluidized bed coating in which the core is suspended in flowing air and the coating solution is sprayed to the core in a suspended state, and a method in which the core is tumbled on a surface on which the coating solution is present.

Particularly when the fluidized bed coating is used, a uniform coating can be formed on the surface of the core and hence the resin coat layer can be stably formed. This fluidized bed coating is disclosed, for example, in Japanese Patent O.P.I. Publication No. 155049/1979.

The silicone resin and the carbon fluoride may preferably be mixed in an amount ranging from 0.3% by weight to 3% by weight in total so that the resistivity of the carrier can be controlled in a preferable range.

In the formation of the resin coat layer, different type of resin(s) may optionally be used in combination. Such different type of resin(s) may include, for example, acrylic resins, styrene resins, epoxy resins, urethane resins, polyamide resins, polyester resins, acetal resins, polycarbonate resins, phenol resins, vinyl chloride resins, vinly acetate resins, cellulose resins, polyolefin resins, and copolymer resins or compounded resins of any of these.

The carrier of the present invention is mixed with a toner to make up a two-component developer. There are no particular limitations on the toner, and any conventionally known toners can be used.

EXAMPLES

The present invention will be described below by giving Examples and Comparative Examples. In the following, "part(s)" refers to "part(s) by weight".

EXAMPLE 1

| | |
|---|---|
| Silicone resin | 90 parts |

-continued

| | |
|---|---|
| (SR-2411; solid content: 10%; available from Toray Dow Corning Silicone Co., Ltd.) | |
| Carbon fluoride (#2065, available from Allied Corp.; degree of fluorination in the compositional formula represented by CFx: x = 1.1; BET specific surface area: 320 $m^2/g$) | 3 parts |

The above materials were subjected to ultrasonic dispersion for 30 minutes to give a coating solution.

The resulting coating solution was applied to 1,000 parts of spherical ferrite particles having an average particle diameter of 100 μm, using a fluidized bed coating apparatus, followed by heat treatment at 200° C. for 1 hour, and then agglomerates were sifted to produce a carrier. This is designated as carrier A.

EXAMPLE 2

Carrier B was produced in the same manner as in Example 1 except that the amount of carbon fluoride mixed was changed to 6 parts.

EXAMPLE 3

Carrier C was produced in the same manner as in Example 1 except that the carbon fluoride was replace with a carbon fluoride having a degree of fluorination of x=0.07 and a BET specific surface area of 160 $m^2/g$.

EXAMPLE 4

Carrier D was produced in the same manner as in Example 3 except that the amount of carbon fluoride mixed was changed to 6 parts.

COMPARATIVE EXAMPLE 1

Comparative carrier 1 was produced in the same manner as in Example 1 except that no carbon fluoride was used.

COMPARATIVE EXAMPLE 2

Comparative carrier 2 was produced in the same manner as in Example 1 except that the carbon fluoride was replace with a carbon fluoride having a degree of fluorination of x=1.1 and a BET specific surface area of 87 $m^2/g$.

Preparation of toner

| | |
|---|---|
| Styrene/acrylate resin | 100 parts |
| Carbon black | 10 parts |
| Low-molecular weight polypropylene | 2 parts |
| Ethylenebisstearoylamide | 3 parts |

The above materials were mixed and kneaded using a ball mill, followed by pulverization and classification to give colored particles with an average particle diameter of 10 μm. Subsequently, hydrophilic silica powder was added to the resulting colored particles in an amount of 0.4% by weight to produce a toner.

Preparation of two-component developer

Each of the above carriers produced in Examples and Comparative Examples and the above toner were mixed in such a proportion that the toner was in a concentration of 4% by weight to give corresponding two-component developers.

Test

Using each of the above two-component developers, practical picture tests to form copied images using an electrophotographic copying machine U-Bix 1017 (manufactured by Konica Corporation) were carried out on the following test items. Results obtained are shown in Tables 1 and 2 set out later.

Triboelectric charge quantity

Determined by the blow-off method usually used.

Reverse-polarity toner ratio

Using a charge quantity distribution measuring apparatus E-SPART Analyzer (manufactured by Hosokawa Micron Corporation), the mass ratios of reverse-polarity toners (mass ratios of negatively charged toners in positively charged developer) were determined.

Fog

Using Sakura Densitometer (manufactured by Konica Corporation), the relative density with respect to a white ground having a copy density of 0.0 was measured. An instance in which it was less than 0.01 was evaluated as "A", and an instance in which it was 0.01 or more, as "C".

Solid image density

Using Sakura Densitometer (manufactured by Konica Corporation), the relative density with respect to a copied image on a white ground having a density of 0.0 was measured, and copied-image density of a solid image corresponding to an original picture density of 1.2 was measured.

Durability

Using Sakura Densitometer (manufactured by Konica Corporation), the relative density with respect to a copied image on a white ground having a density of 0.0 was measured, and the density was evaluated on the basis of the number of times of copying at the time when the density of a solid image came to be 1.0 or less.

Toner-spent

The toners were removed from the developers by blowing-off, and the surfaces of the remaining carriers were observed using a scanning electron microscope.

TABLE 1

| | Triboelectric charge quantity of toner | | Reverse-polarity toner ratio | |
|---|---|---|---|---|
| | Initial stage | On 200,000 sheet running | Initial stage | On 200,000 sheet running |
| Example: | | | | |
| 1 | +23 μC/g | +22 μC/g | 3% | 4% |
| 2 | +25 μC/g | +24 μC/g | 2% | 4% |
| 3 | +17 μC/g | +15 μC/g | 4% | 3% |
| 4 | +17 μC/g | +15 μC/g | 4% | 3% |
| Comparative Example: | | | | |
| 1 | +8 μC/g | +4 μC/g | 13% | 25% |
| 2 | +15 μC/g | +8 μC/g | 5% | 22% |

TABLE 2

| | Fog | | Solid image density | | | |
|---|---|---|---|---|---|---|
| | Initial stage | 200,000 sheet running | Initial stage | 200,000 sheet running | Durability (sheets) | Toner-spent (sheets) |
| Example: | | | | | | |
| 1 | A | A | 1.40 | 0.35 | 200,000 or more | No, up to 200,000 |
| 2 | A | A | 1.38 | 1.34 | 200,000 or more | No, up to 200,000 |
| 3 | A | A | 1.41 | 1.38 | 200,000 or more | No, up to 200,000 |
| 4 | A | A | 1.40 | 1.36 | 200,000 or more | No, up to 200,000 |
| Comparative Example: | | | | | | |
| 1 | C | C | 1.15 | 0.92 | 70,000 | Occurred on 70,000 |
| 2 | C | C | 1.08 | 0.85 | 90,000 | Ocourred on 100,000 |

As will be understood from the foregoing results, the carriers of the present invention cause occurrence of the reverse-polarity toner only at a small ratio, have a good chargeability, and can obtain copied images with less fog and high solid image density. Moreover, because the carbon fluoride with a low surface energy is uniformely dispersed on the carrier surface, the triboelectric charge quantity of the toner shows only a very small change with time, a stable development performance can be maintained without causing the toner-spent, and the durability can be remakably high.

The comparative carrier 1 containing no carbon fluoride shows a poor triboelectric chargeability from the initial stage, causes the reverse-polarity toner in a large quantity, causes fog, causes a decrease in solid image density, causes the toner-spent, and has a poor durability.

The comparative carrier 2 in which the carbon fluoride has a BET specific surface area of 100 $m^2/g$ or less has a triboelectric chargeability showing a great change with time, and has a poor durability.

According to the present invention, it is possible to obtain a carrier that can stably exhibit a superior triboelectric chargeability.

Without any charge control agent incorporated into a toner, the toner can be positively triboelectrically charged in a proper range, and good images can be stably formed over a large number of times without causing any fog.

What is claimed is:

1. A carrier for developing an electrostatic image comprising a core particle and a resin layer coated on the core particle, wherein the resin layer comprises a silicone resin and a carbon fluoride having a BET specific surface area of not less than 100 $m^2/g$.

2. A carrier according to claim 1, wherein the BET specific surface area is not less than 180 $m^2/g$.

3. A carrier according to claim 1, wherein an average diameter of carbon fluoride is not more than 1 μm.

4. A carrier according to claim 1, wherein an amount of carbon fluoride is 5 to 60 weight % of the resin layer.

5. A carrier according to claim 1, wherein the core is a magnetic material having an average diameter of 20 to 200 μm.

6. A carrier according to claim 1, wherein a total amount of the silicone resin and the carbon fluoride is 0.3 to 3 wt % of the core particles.

7. A carrier for developing an electrostatic image comprising a magnetic core particle having an average particle size of 20 to 200 μm and a layer coated on the core particle, wherein the resin layer comprises a silicone resin and a carbon fluoride having a BET specific surface area of not more than 180 $m^2/g$ and an average diameter of not more than 1 μm in an amount of carbon fluoride being 5 to 60 weight % of the resin layer.

* * * * *